US006115976A

United States Patent [19]

Gomez

[11] Patent Number: 6,115,976

[45] Date of Patent: Sep. 12, 2000

[54] DOOR EDGE ASSEMBLY FOR CREATING A SMOKE SEAL ABOUT A CLOSED DOOR MOUNTED WITHIN A DOOR FRAME

[75] Inventor: Steven V. Gomez, Denver, Colo.

[73] Assignee: Wood Door Products, Inc., Denver, Colo.

[21] Appl. No.: 09/399,421

[22] Filed: Sep. 20, 1999

[51] Int. Cl.[7] ..... E04C 2/00

[52] U.S. Cl. ..... 52/232; 52/784.11; 52/784.15; 52/783.13; 52/802.1

[58] Field of Search ..... 52/784.11, 784.15, 52/783.13, 232, 802.1

[56] References Cited

U.S. PATENT DOCUMENTS

| | | | |
|---|---|---|---|
| 3,566,541 | 3/1971 | Coulter | 52/232 |
| 3,955,330 | 5/1976 | Wendt | 52/204 |
| 4,343,127 | 8/1982 | Greve | 52/785 |
| 4,485,601 | 12/1984 | DeBoel | 52/232 |
| 5,501,045 | 3/1996 | Wexler | 52/232 |
| 5,816,017 | 10/1998 | Hunt et al. . | |
| 5,943,824 | 8/1999 | Tatara . | |
| 5,970,670 | 10/1999 | Hoffman | 52/232 |

*Primary Examiner*—Carl D. Friedman
*Assistant Examiner*—Kevin McDermott
*Attorney, Agent, or Firm*—Emery L. Tracy

[57] ABSTRACT

An assembly for sealing a fire resistant door within a door frame during a fire event is provided. The fire resistant door has a plurality of edges. The assembly comprises a first body portion and a second body portion secured to the first body portion. An expansion mechanism between the first body portion and the second body portion for moving the second body portion in a direction generally away from the first body portion and against the door frame upon attaining a predetermined temperature with the first body portion, the second body portion, and the expansion means forming a door edge device wherein the door edge device is secured to at least one of the edges of the fire resistant door.

13 Claims, 1 Drawing Sheet

DOOR EDGE ASSEMBLY FOR CREATING A SMOKE SEAL ABOUT A CLOSED DOOR MOUNTED WITHIN A DOOR FRAME

BACKGROUND OF THE INVENTION

1. Field of the Invention

This invention relates generally to a door mounted within a door frame and, more particularly, it relates to a door edge assembly for creating a smoke seal about a closed door mounted within a door.

2. Description of the Prior Art

A fire retardant door, often referred to as a "fire door", is installed in a building for preventing the passage or spread of fire during a fire event from one part of the building to another. In the interest of public safety, standards have been set by governmental agencies, building code authorities, and insurance companies for the installation and performance of fire door assemblies that pass industry-wide acceptance tests.

Fire rating is an important safety factor in the protection of people within a structure, whether it be an office building, hospital, or nursing home for the sick or elderly. Fire ratings vary with the thickness of a door, or the material composition of the door.

Standard test methods for fire door assemblies, such as ASTM E-152, UL 10(b), or NFPA 252, measure the ability of a door assembly to remain in an opening during a fire to retard the passage of the fire during the fire event and evaluate the fire resistant properties of the door. In conducting such tests, doors are mounted in an opening of a fire proof wall. One side of the door is exposed to a predetermined range of temperatures over a predetermined period of time, followed by the application of a high pressure hose stream that causes the door to erode and provides a thermal shock to the assembly. Doors are given a fire rating based on the duration of the heat exposure of twenty (20) minutes, thirty (30) minutes, forty-five minutes (45) minutes, one (1) hour, one and one-half (1½) hours, or three (3) hours. The door assembly receives the fire rating when it remains in the opening for the duration of the fire test and hose stream, within certain limitations of movement and without developing openings through the door either at the core or around the edge material.

The spacing around the door between an adjacent door or doorjamb of a door frame is also an important factor in providing and maintaining a predetermined, desired fire rating. This spacing is important in both maintaining fire during the fire event from spreading into an adjacent room around the door edges and preventing or deterring the spread of fire smoke into an adjacent room around the door edges. It is well known that the fire smoke can be just as dangerous, if not more dangerous, than the actual fire itself. Unfortunately, despite many attempts to effectively seal adjacent rooms from entry of fire smoke, attempts in the past have failed to effectively seal the areas around the door edges from the entry of fire smoke between the room experiencing the fire event and the immediately adjacent rooms.

Accordingly, there exists a need for a door assembly for creating a smoke seal about a closed door within a door frame which effectively seals any adjacent rooms from fire smoke during a fire event in an adjoining room. Additionally, a need exists for a door assembly for creating a smoke seal about a closed door within a door frame which maintains a smoke seal between adjacent rooms during a fire event for at least the time duration of the door's fire rating. Furthermore, there exists a need for a door assembly for creating a smoke seal about a closed door within a door frame which does not effect the aesthetic appearance of the door.

SUMMARY

The present invention is an assembly for sealing a fire resistant door within a door frame during a fire event. The fire resistant door has a plurality of edges. The assembly comprises a first body portion and a second body portion secured to the first body portion. An expansion mechanism between the first body portion and the second body portion for moving the second body portion in a direction generally away from the first body portion and against the door frame upon attaining a predetermined temperature with the first body portion, the second body portion, and the expansion means forming a door edge device wherein the door edge device is secured to at least one of the edges of the fire resistant door.

The present invention further includes a door edge assembly for creating a smoke seal about a closed door in a door frame during a fire event. The door has a plurality of door edges. The door edge assembly comprises a receiving slot formed in each of the door edges and means secured within each of the receiving slots for sealing the door within the door frame with the means expanding against the door frame upon the means attaining a predetermined temperature thereby sealing smoke from passing between the door and the door frame.

The present invention further still includes a method for creating a smoke seal about a closed door in a door frame during a fire event. The door has a plurality of door edges. The method comprises forming a receiving slot in each of the door edges, securing an expandable member within each of the receiving slots, and expanding the expandable member against the door frame upon the expandable member attaining a predetermined temperature.

DETAILED DESCRIPTION OF THE PREFERRED EMBODIMENTS

Figure 1:
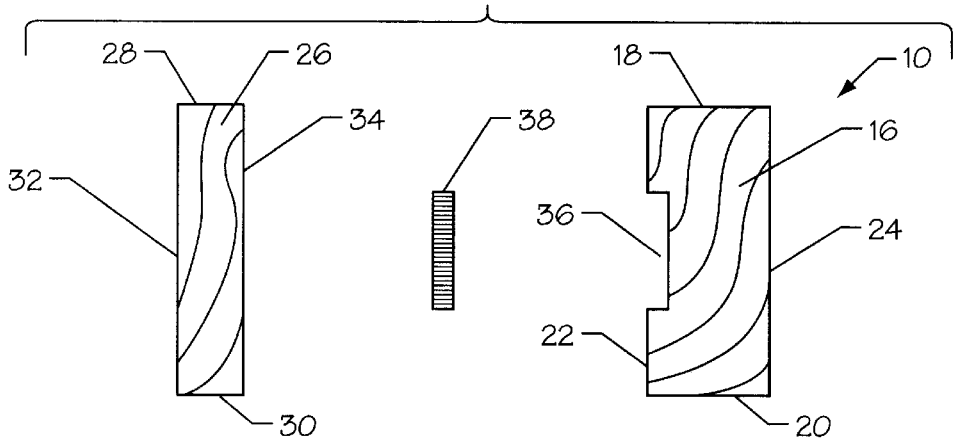
FIG. 1 is an exploded side view illustrating a door edge assembly for creating a smoke seal about a closed door in a door frame during a fire event, constructed in accordance with the present invention.

As illustrated in FIG. 1, the present invention is a door edge assembly, indicated generally at 10, for creating a smoke seal about a closed door 12 in a door frame 13. Each door 12 typically has four edges 14, namely a top edge, a bottom edge, hinge side edge, and a latch throw side edge. It should be noted that the door edge assembly 10 of the present invention is constructed and designed to be used on all four edges 14 of the door 12 for creating an effective smoke seal around the edges 14 of the door 12 between adjacent rooms during a fire event.

Preferably, the door 12 is fire retardant door or fire door is installed in the door frame 13 of a building for preventing the passage or spread of fire during a fire event from one part of the building to another. Especially when used as an interior door, the door 12 must also be aesthetically pleasing. Therefore, the door 12 can include overlaying a core of incombustible material with a thin wood veneer facing that provides the door 12 with an attractive appearance. In addition, other types of aesthetically pleasing doors 12 are within the scope of the present invention including fire resistant or fireproof fiberboard doors.

The door edge assembly 10 of the present invention includes a first body strip 16 having a first side surface 18, a second side surface 20, a front side surface 22, and a back side surface 24 and a second body strip 26 having a first side surface 28, a second side surface 30, a front side surface 32, and a back side surface 34. Both the first body strip 16 and the second body strip 26 are preferably constructed from a solid wood material, such as poplar or finger joint pine. It should be noted, however, that it is within the scope of the present invention to construct the first body strip 16 and the second body strip 26 from other materials besides a solid wood material including, but not limited to, wood composite materials, plastic, metal, etc.

Preferably, the first body strip 16 has a width of approximately one and seven-eighths (1⅞") inches and a variable thickness. It is within the scope of the present invention for the first body strip 16 to have a width greater than or less than approximately one and seven-eighths (1⅞") inches. In addition, preferably the second body strip 26 has a width of approximately one and seven-eighths (1⅞") inches and a thickness of approximately seven-sixteenths (7⁄16") inch. It is within the scope of the present invention for the second body strip 26 to have a width greater than or less than approximately one and seven-eighths (1⅞") inches and a thickness of greater than or less than approximately seven-sixteenths (7⁄16") inch. The length of both the first body strip 16 and the second body strip 26 is preferably at least equal to the length of the door edge 14 of the door 12.

It should be noted that on several of the door edges 14 of the door 12, the length of both the first body strip 16 and the second body strip 26 can extend beyond the adjacent door edge 14 to overlap the first body strip 16 and the second body strip 26 mounted on the adjacent door edge 14, as will be described in further detail below.

The door edge assembly 10 of the present invention further includes a slot formed 36 in the front side surface 22 of the first body strip 16. The slot 36 preferably has a depth of approximately one-eighth (⅛") inch and a width of approximately three-quarters (¾") inch although having the slot 36 have a depth greater than or less than approximately one-eighth (⅛") inch and a width greater than or less than approximately three-quarters (¾") inch is within the scope of the present invention. The length of the slot 36 is preferably equal to the length of the door edge 14 of the door 12, the first body strip 16, and the second body strip 26.

Additionally, the door edge assembly 10 of the present invention further includes a intumescent strip 38 or other heat expandable materials receivable within the slot 36. The intumescent strip 38 is constructed and designed to expand upon reaching a certain reaction temperature when exposed to a fire event or other extreme heat source. Preferably, the dimensions of the intumescent strip 38 are approximately equal to the dimensions of the slot 36 such that the intumescent strip 38 does not extend beyond the front side edge 22 of the first body strip 16.

The construction of the door edge assembly 10 of the present invention will now be described in detail. While a preferred embodiment of construction will be described, as will be understood by those persons skilled in the art, a variety of construction methods are within the scope of the present invention.

Figure 2:
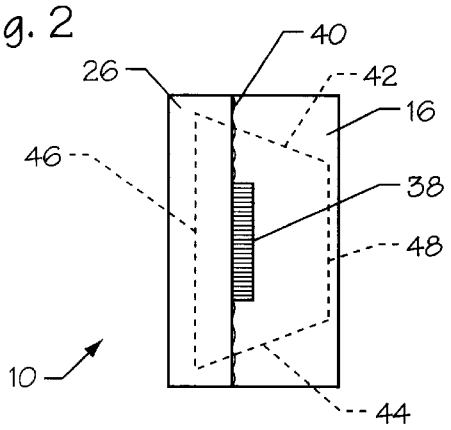
FIG. 2 is a side view illustrating an embodiment of the door edge assembly for creating a smoke seal about a closed door in a door frame during a fire event, constructed in accordance with the present invention, prior to forming the door edge assembly into the proper configuration and the final configuration of the door edge assembly being illustrated in phantom.
Figure 4:
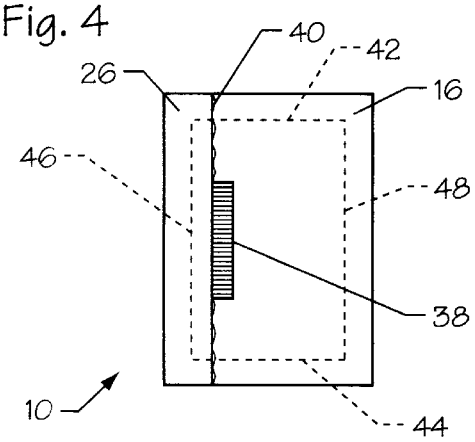
FIG. 4 is a side view illustrating another embodiment of the door edge assembly for creating a smoke seal about a closed door in a door frame during a fire event, constructed in accordance with the present invention, prior to forming the door edge assembly into the proper configuration and the final configuration of the door edge assembly being illustrated in phantom.

As illustrated in FIGS. 2 and 4, the intumescent strip 38 is positioned in the slot 36 formed in the front side surface 22 of the first body strip 16. Next, the back side surface 34 of the second body strip 26 is secured to the front side surface 22 of the first body strip 16 by a fastening mechanism 40 thereby completely covering the intumescent strip 38. Preferably, the fastening mechanism 40 is an adhesive layer applied between the back side surface 34 of the second body strip 26 and the front side surface 22 of the first body strip 16 although other types of fastening mechanism are within the scope of the present invention. The adhesive bond layer 40 between the first body strip 16 and the second body strip 26 can be overcome by the expansion of the intumescent strip 38 during exposure of the door 12 to a fire event or other heat source as will be described in further detail below.

After the first body strip 16 and the second body strip 26 have been fastened together with the intumescent strip 38 therebetween, the combined first and second body strip 16, 26 are formed into the final door edge assembly 10 of the present invention. In particular, a portion of the first side surface 18, the second side surface 20, and the back side surface 24 of the first body strip 16 and a portion of the first side surface 28, the second side surface 30, and the front side surface 32 of the second body strip 26 are removed thereby creating an assembly first side surface 42, an assembly second side surface 44, an assembly front side surface 46, and an assembly back side surface 48.

Figure 3:
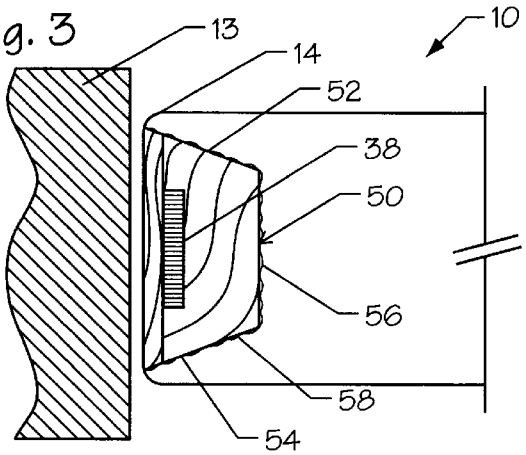
FIG. 3 is a side view illustrating the embodiment of the door edge assembly for creating a smoke seal about a closed door in a door frame during a fire event as illustrated in FIG. 2, constructed in accordance with the present invention, with the door edge assembly being positioned within the door edge of the door.
Figure 5:
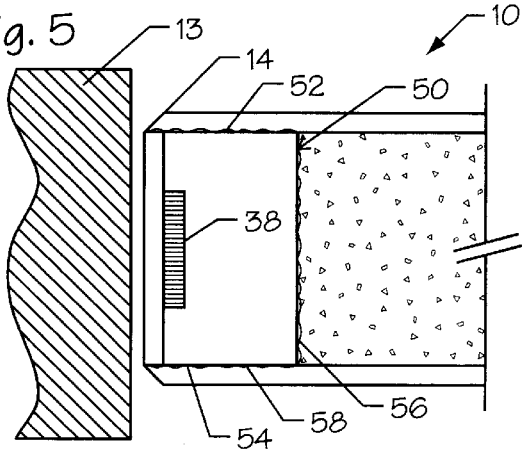
FIG. 5 is a side view illustrating the embodiment of the door edge assembly for creating a smoke seal about a closed door in a door frame during a fire event as illustrated in FIG. 4, constructed in accordance with the present invention, with the door edge assembly being positioned within the door edge of the door.

As illustrated in FIG. 3, the door edge assembly 10 of the present invention can have a substantially trapezoidal cross-sectional configuration. As illustrated in FIG. 5, the door edge assembly 10 can also have a substantially rectangular cross-sectional configuration. While the door edge assembly 10 has been described and illustrated as having a substantially trapezoidal cross-sectional configuration or a substantially rectangular cross-section configuration, it is within the scope of the present invention that the door edge assembly 10 have a variety of cross-sectional configurations including, but not limited to, a half-circular, a half-oval cross-sectional configuration, a triangular cross-sectional configuration, etc.

With the door edge assembly 10 of the present invention having a substantially trapezoidal cross-sectional configuration, as illustrated in FIGS. 2 and 3, preferably, the angle between the assembly first side surface 42 and the assembly front side surface 46 is an acute angle of approximately twenty (20°) degrees and the angle between the assembly second side surface 44 and the assembly front side surface 46 is approximately twenty (20°) degrees. It is within the scope of the present invention, however, to have the angle between the assembly first side surface 42 and the assembly front side surface 46 and between the assembly second side surface 44 and the assembly front side surface 46 be greater than approximately twenty (20°) degrees up to and including approximately ninety (90°) degrees, e.g., a substantially rectangular cross-sectional configuration, as illustrated in FIGS. 4 and 5, or less than approximately twenty (20°) degrees.

In order to accommodate the door edge assembly 10 of the present invention, each edge 14 of the door 12 includes a receiving slot 50 formed therein and configured and shaped as the particular door edge assembly 10. Preferably, the receiving slot 50 extends the entire length of the edge 14 of the door 12 for receiving the door edge 10.

As illustrated in FIG. 3, the receiving slot 50 can have a substantially trapezoidal cross-sectional configuration for receiving the door edge assembly 10 having a substantially trapezoidal cross-sectional configuration or, as illustrated in FIG. 5, the receiving slot 50 can have a substantially rectangular cross-sectional configuration for receiving the door edge assembly 10 having a substantially rectangular cross-sectional configuration. It should be noted, however, that a receiving slot 50 having other cross-sectional configurations including, but not limited to, a half-circular, a half-oval cross-sectional configuration, a triangular cross-sectional configuration, etc., are within the scope of the present invention. The actual cross-sectional configuration of the receiving slot 50 is determined by the desired and/or required amount of surface area necessary for securing the door edge assembly 10 within the receiving slot 50 and maintaining the door edge assembly 10 from separating from within the receiving slot 50 of the edge 14 of the door 12.

In the embodiment as illustrated in FIGS. 3 and 5, wherein the receiving slot 50 has a substantially trapezoidal cross-sectional configuration and a substantially rectangular cross-sectional configuration, respectively, the receiving slot 50 has a first slot surface 52, a second slot surface 54, and a third slot surface 56. Preferably, the angle between the first slot surface 52 and the third slot surface 56 is an angle of approximately seventy (70°) degrees and the angle between the second slot surface 54 and the third slot surface 56 is an angle of approximately seventy (70°) degrees. Like the angles assembly side surfaces 42, 44, 46 of the door edge assembly 10, it is within the scope of the present invention, however, to have the angle between the first slot surface 52 and the third slot surface 56 and between the second slot surface 54 and the third slot surface 56 be greater than approximately seventy (70°) degrees up to and including approximately ninety (90°) degrees, e.g., a substantially rectangular cross-sectional configuration, as illustrated in FIG. 5, or less than approximately seventy (70°) degrees. In any event, to provide a corresponding fit, the door edge assembly 10 preferably has the same cross-sectional configuration as the receiving slot 50, as illustrated in FIGS. 3 and 5.

The door edge assembly 10 of the present invention is positioned within the receiving slot 50 such that the assembly first side surface 42 of the door edge assembly 10 is positioned against the first slot surface 52 of the receiving slot 50, the assembly second side surface 44 of the door edge assembly 10 is positioned against the second slot surface 54 of the receiving slot 50, and the assembly back side surface 48 of the door edge assembly 10 is positioned against the third slot surface 56 of the receiving slot 50. Preferably, the door edge assembly 10 is appropriately sized and shaped such that the assembly front side surface 46 is even with the edges 14 of the door 12. If the assembly front side surface 46 of the door edge assembly 10 extends beyond the edges 14 of the door 12 it can be planed or sanded until the assembly front side surface 46 is even with the edges 14 of the door 12.

An adhesive layer 58, as illustrated in FIGS. 3 and 5, can be applied between each of the assembly side surfaces 42, 44, 48 of the door edge assembly 10 and each of the slot surfaces 52, 54, 56 of the receiving slot 50, respectively, to maintain the relative position of the door edge assembly 10 within the receiving slot 50. While the door edge assembly 10 has been described as being secured within the receiving slot 50 with adhesive other types of fastening mechanisms are within the scope of the present invention. Furthermore, all door hardware (not shown) can be secured directly to the assembly front side surface 42 of the door edge assembly 10 and the door 12 can then be mounted within the door frame 13.

During a fire event, the intumescent strip 38 expands upon reaching the predetermined reaction temperature. The expansion of the intumescent strip 38 within the door edge assembly 10 causes the second body strip 26 to separate from the first body strip 16 in a direction generally away from the first body strip 16 and toward the door frame 13. The second body strip 26 continues to move in a generally outward direction upon expansion of the intumescent strip 38 until the second body strip 26 contacts against the door frame 13.

The contact of the second body strip 26 of the door edge assembly 10 with the door frame 13 creates a seal between the door edge assembly 10 and the door frame 13 along all of the edges 14 of the door 12 such that smoke can not pass therethrough. Any overlap of the door edge assembly 10 with an adjacent door edge assembly 10 on an adjacent door edge 12 further seals the door 12 within the door frame.

Furthermore, the intumescent strip 38 inhibits passage of smoke between the first body strip 16 and the second body strip 26 along all of the edges 14 of the door 12. As a result of the second body strip 26 contacting the door frame 13 and the presence of the intumescent strip 38 a fire event in a room or other part of the building is inhibited from entering the adjacent room about the door 12.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. An assembly for sealing a fire resistant door within a door frame during a fire event, the fire resistant door having a plurality of edges, the assembly comprising:

a first body portion constructed from a wood material;

a second body portion constructed from a wood material secured to the first body portion; and expansion means between the first body portion and the second body portion for moving the second body portion in a direction generally away from the first body portion and against the door frame upon attaining a predetermined temperature, the first body portion, the second body portion, and the expansion means forming a door edge device;

wherein the door edge device is secured to at least one of the edges of the fire resistant door.

2. The assembly of claim 1 and further comprising a receiving slot formed in at least one of the edges of the fire resistant door wherein the door edge device is secured within the receiving slot.

3. The assembly of claim 2 wherein the receiving slot has a cross-sectional configuration selected from the group consisting of trapezoidal and rectangular, and further wherein the door edge device has a substantially equivalent cross-sectional configuration as the receiving slot.

4. The assembly of claim 2 wherein the receiving slot has a cross-sectional configuration selected from the group consisting of triangular, half-circular, and half-oval, and further wherein the door edge device has a substantially equivalent cross-sectional configuration as the receiving slot.

5. The assembly of claim 1 wherein the first body portion, the second body portion, and the expansion means extends along the entire edge of the fire resistant door.

6. The assembly of claim 1 wherein the expansion means is an intumescent strip.

7. The assembly of claim 1 wherein the fire resistant door has four edges, the door edge device being secured to each of the edges of the fire resistant door.

8. The assembly of claim 1 wherein the first body portion has a slot, the expansion means being secured within the slot.

9. A door edge assembly for creating a smoke seal about a closed door in a door frame during a fire event, the door having a plurality of door edges, the door edge assembly comprising:

a receiving slot formed in each of the door edges; and means secured within each of the receiving slots for sealing the door within the door frame, the means expanding against the door frame upon the means attaining a predetermined temperature thereby sealing smoke from passing between the door and the door frame, the means including a first door edge portion constructed from a wood material, a second door edge portion constructed from a wood material, and an expandable core, the expandable core being surrounded by the first door edge portion and the second door edge portion.

10. The door edge assembly of claim 9 wherein the first door edge portion includes a slot, the expandable core receivable within the slot.

11. The door edge assembly of claim 9 wherein the expandable core is a intumescent strip.

12. The door edge assembly of claim 9 wherein upon expansion of the expandable material, the second door edge portion is moved against the door frame.

13. The door edge assembly of claim 9 wherein the receiving slot has a cross-sectional configuration selected from the group consisting of trapezoidal and rectangular, and further wherein the means has a complementary cross-sectional configuration.

* * * * *

US006115976C1

(12) REEXAMINATION CERTIFICATE (4836th)

United States Patent

Gomez

(10) Number: US 6,115,976 C1

(45) Certificate Issued: Aug. 19, 2003

(54) DOOR EDGE ASSEMBLY FOR CREATING A SMOKE SEAL ABOUT A CLOSED DOOR MOUNTED WITHIN A DOOR FRAME

(75) Inventor: Steven V. Gomez, Denver, CO (US)

(73) Assignee: Wood Door Products, Inc., Denver, CO (US)

Reexamination Request:
No. 90/006,149, Nov. 27, 2001

Reexamination Certificate for:

| | |
|---|---|
| Patent No.: | **6,115,976** |
| Issued: | **Sep. 12, 2000** |
| Appl. No.: | **09/399,421** |
| Filed: | **Sep. 20, 1999** |

(51) Int. Cl.[7] ..... B04C 2/00

(52) U.S. Cl. ..... 52/232; 52/784.11; 52/784.15; 52/783; 52/13; 52/802.1

(58) Field of Search ..... 52/784.11, 784.15, 52/783.13, 232, 802.1

(56) References Cited

U.S. PATENT DOCUMENTS

| | | | | | |
|---|---|---|---|---|---|
| 570,391 | A | * | 10/1896 | Fox, II | 114/65 R |
| 1,048,923 | A | * | 12/1912 | Wheeler | 109/80 |
| 4,660,338 | A | * | 4/1987 | Wagner | 49/504 |
| 5,440,843 | A | * | 8/1995 | Langenhorst | 49/463 |
| 5,916,077 | A | * | 6/1999 | Tang | 49/501 |
| 5,931,245 | A | * | 8/1999 | Uetake et al. | 106/602 |
| 6,119,411 | A | * | 9/2000 | Mateu Gil et al. | 109/80 |
| 6,434,899 | B1 | * | 8/2002 | Fortin et al. | 49/501 |

OTHER PUBLICATIONS

BASF Brochure entitled "Palusol Fireboard Panels Versus Fire and Smoke" dated Jun. 1994.

BASF Brochure entitled "The BASF", article entitled "Means of Escape from Fire" by Rudolf Breu, dated 1977.

BASF Brochure entitled "Palusol" dated May 1988.

American VMAG Company Flyer entitled "Palusol Fireboad for Fire–Resistant Building Components and Structures" distributed with 1983 Sweets Catalog, vol. 15.14 am.

* cited by examiner

*Primary Examiner*—Carl D. Friedman

(57) ABSTRACT

An assembly for sealing a fire resistant door within a door frame during a fire event is provided. The fire resistant door has a plurality of edges. The assembly comprises a first body portion and a second body portion secured to the first body portion. An expansion mechanism between the first body portion and the second body portion for moving the second body portion in a direction generally away from the first body portion and against the door frame upon attaining a predetermined temperature with the first body portion, the second body portion, and the expansion means forming a door edge device wherein the door edge device is secured to at least one of the edges of the fire resistant door

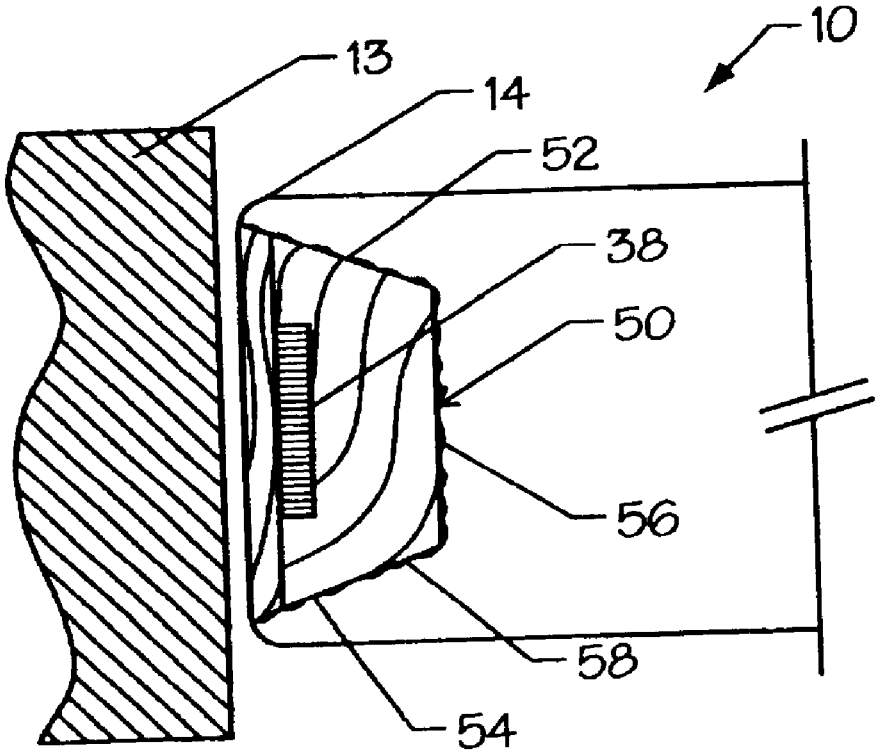

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2–4 and 13 are cancelled.

Claims 1 and 9 are determined to be patentable as amended.

Claims 5–8 and 10–12, dependent on an amended claim, are determined to be patentable.

1. An assembly for sealing a fire resistant door within a door frame during a fire event, the fire resistant door having a plurality of edges, the assembly comprising:

a first body portion constructed from a wood material;

a second body portion constructed from a wood material secured to the first body portion; and expansion means between the first body portion and the second body portion for moving the second body portion in a direction generally away from the first body portion and against the door frame upon attaining a predetermined temperature, the first body portion, the second body portion, and the expansion means forming a door edge device;

*a receiving slot formed in at least one of the edges of the fire resistant door;* wherein the door edge device is secured [to at least one of the edges of the fire resistant door] *within the receiving slot; and*

*wherein the receiving slot has a trapezoidal cross-sectional configuration and the door edge device has a substantially equivalent cross-sectional configuration as the receiving slot.*

9. A door edge assembly for creating a smoke seal about a closed door in a door frame during a fire event, the door having a plurality of door edges, the door edge assembly comprising:

a receiving slot formed in each of the door edges*, the receiving slot having a trapezoidal cross-sectional configuration*; and means secured within each of the receiving slots for sealing the door within the door frame, the means expanding against the door frame upon the means attaining a predetermined temperature thereby sealing smoke from passing between the door and the door frame, the means including a first door edge portion constructed from a wood material, a second door edge portion constructed from a wood material, and an expandable core, the expandable core being surrounded by the first door edge portion and the second door edge portion*;*

*wherein the means has a substantially equivalent cross-sectional configuration.*

* * * * *